US005204721A

United States Patent [19]

Sharpe

[11] Patent Number: 5,204,721

[45] Date of Patent: Apr. 20, 1993

[54] DEVELOPER AUGER FOR USE IN AN ELECTROPHOTOGRAPHIC PRINTING MACHINE

[75] Inventor: Gary M. Sharpe, Hilton, N.Y.

[73] Assignee: Xerox Corporation, Stamford, Conn.

[21] Appl. No.: 749,850

[22] Filed: Aug. 26, 1991

[51] Int. Cl.[5] ..... G03G 15/06

[52] U.S. Cl. ..... 355/260; 366/323; 366/327

[58] Field of Search ..... 355/245, 260, 246, 210, 355/200, 253; 118/653; 366/318, 323, 327, 321, 89

[56] References Cited

U.S. PATENT DOCUMENTS 3,271,819 9/1966 Lacher ..... 366/89
4,583,842 4/1986 Shimono et al. ..... 355/260
4,682,874 7/1987 Fantuzzo ..... 355/246
4,813,531 3/1989 Tannascoli et al. ..... 198/671
4,937,625 6/1990 Kato et al. ..... 355/245

*Primary Examiner*—R. L. Moses
*Assistant Examiner*—Shuk Y. Lee

[57] ABSTRACT

A developer auger possessing a plurality of flight segments is described for use in a development system of an electrophotographic printing machine. The developer auger includes a shaft and a first flight portion, mounted on the shaft, wherein the first flight portion includes at least two flight segments which define a first pitch distance. The developer auger further includes a second flight portion, mounted on the shaft and positioned adjacent the first flight portion, wherein the second flight portion includes at least two flight segments which define a second pitch distance which is greater than the first pitch distance.

14 Claims, 4 Drawing Sheets

DEVELOPER AUGER FOR USE IN AN ELECTROPHOTOGRAPHIC PRINTING MACHINE

This invention relates generally to an electrophotographic printing machine adapted to produce highlight color copies, and more particularly concerns a developer auger which is used in a development system of an electrophotographic printing machine.

The features of the present invention may be used in the printing arts and, more particularly, in electrophotographic printing. In the process of electrophotographic printing, a photoconductive surface is charged to a substantially uniform potential. The photoconductive surface is selectively exposed to record an electrostatic latent image corresponding to the informational areas of an original document being reproduced. Thereafter, a developer material is transported into contact with the electrostatic latent image. Generally, the developer material comprises toner particles adhering triboelectrically to carrier granules. The toner particles are attracted from the carrier granules of the developer material onto the latent image. The resultant toner particle image is then transferred from the photoconductive surface to a copy sheet and permanently affixed thereto. The foregoing generally describes a typical mono-color electrophotographic copying machine.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred sequentially to the copy sheet to form the color highlighted copy. A color highlight printing machine of this type is a two pass machine. Single pass highlight color printing machines using tri-level printing have also been developed. Tri-level electrophotographic printing is described in detail in U.S. Pat. No. 4,078,929. As described in this patent, the latent image is developed with toner particles of first and second colors. The toner particles of one of the colors are positively charged and the toner particles of the other color are negatively charged. In one embodiment, the toner particles are supplied by a developer material which comprises a mixture of triboelectrically relatively positive and relatively negative carrier beads. The carrier beads support, respectively, the relatively negative and relatively positive toner particles. Such a developer material is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level electrophotographic printing, the charge on the photoconductive surface is divided in three ways, rather than two ways as is the case in mono-color printing. The photoconductive surface is charged, typically to about 900 volts. Thereafter, the photoconductive surface is selectively exposed, such that one image corresponding to charged image areas remains at the full potential of 900 volts. The other image, which corresponds to discharged image areas, is selectively exposed to discharge the photoconductive surface to its residual potential of typically about 100 volts. The background areas are selectively exposed to reduce the photoconductive surface potential to about midway between the charged and discharged potentials, (typically about 500 volts). The developer unit, arranged to develop the charged image areas, is typically biased to about 600 volts, and the developer unit, arranged to develop the discharged image areas, is biased to about 400 volts. The single pass nature of this system dictates that the electrostatic latent image pass through the developer units in a serial fashion. The latent image has a high charged image potential region and a low charged image potential region. The first developer unit is arranged to develop the discharged image areas and the second developer unit is arranged to develop the charged image areas.

In each of the above process of printing, it is necessary to dispense additional toner particles into the developer mixture as the toner particles are depleted from the developer material. In this way, the concentration of toner particles within the developer material is maintained substantially constant. To achieve the above, electrophotographic printing machines frequently have dispensers which discharge toner particles into the development system. However, a printing defect sometimes occurs when fresh toner particles are dispensed into the existing development material of the development system and this new mixture is transported into contact with the electrostatic image without prior sufficient blending. The above printing defect may take the form of excessive toner particles being transferred to the latent image thus resulting in smudged areas on the copy sheet. It is, therefore, desirable to have a development system which would provide sufficient blending of fresh toner particles with existing developer material prior to bringing the mixture thereof into contact with the electrostatic image. It would also be desirable to transport the developer material within the development system at a substantially constant rate of speed while providing for sufficient blending thereof prior to bringing the developer material into contact with the latent image.

The following disclosures may be relevant to certain aspects of the present invention:

U.S. Pat. No. 4,682,874 Patentee: Fantuzzo Issued: Jul. 28, 1987

U.S. Pat. No. 4,813,531 Patentee: Tannascoli et al. Issued: Mar. 21, 1989

U.S. Pat. No. 4,937,625 Patentee: Kato et al. Issued: Jun. 26, 1990

Co-pending U.S. patent application Ser. No. 07/708,429 Applicant: Drawe et al. Filing Date: May 31, 1991

The relevant portions of the foregoing patents may be briefly summarized as follows:

U.S. Pat. No. 4,682,874 discloses an apparatus which detects when particles being dispensed into a development system have been depleted and provides a display of that condition. The apparatus advances particles from a store thereof to the development system. A detector, associated with the particle advancer, senses the exhaustion of particles being advanced to the development system. The development system shown herein includes a pair of augers.

U.S. Pat. No. 4,813,531 describes a developer transport apparatus which includes a rotatable auger for transporting developer along its length from a developer entry to a developer delivery end.

U.S. Pat. No. 4,937,625 discloses a developing device for developing a toner image on a cylindrical electrophotographic photoreceptor. The device includes a toner container which extends perpendicularly to the direction of the photoreceptor and a toner transporting device for moving the toner supplied from the container in the direction of the axis of the photoreceptor. The toner transporting device includes a pair of screws, each having a stirrer plate positioned thereon to redirect the flow of toner.

Co-pending U.S. patent application Ser. No. 07/708,429 describes an apparatus which develops an electrostatic latent image with toner particles. The toner particles being used to develop the latent image are reclaimed and unused. An auger transports the unused and reclaimed toner particles to a discharge region where the toner particles are dispensed into the sump of the developer housing. The auger has a greater particle advancing capacity, in the region adjacent the container storing reclaimed toner particles and extending to the housing storing unused toner particles, than in the region adjacent the housing storing unused toner particles.

In accordance with one aspect of the present invention, there is provided a developer auger possessing a plurality of flight segments for use in a development system of an electrophotographic printing machine. The developer auger comprises a shaft and a first flight portion, mounted on the shaft, wherein the first flight portion comprises at least two flight segments which define a first pitch distance. The developer auger further comprises a second flight portion, mounted on the shaft and positioned adjacent the first flight portion, wherein the second flight portion comprises at least two flight segments which define a second pitch distance which is greater than the first pitch distance.

Pursuant to another aspect of the present invention, there is provided an electrophotographic printing machine of the type having a development system which transports developer material for subsequent image development that includes a developer auger possessing a plurality of flight segments. The printing machine comprises a shaft and a first flight portion, mounted on the shaft, wherein the first flight portion comprises at least two flight segments which define a first pitch distance. The printing machine further comprises a second flight portion, mounted on the shaft and positioned adjacent the first flight portion, wherein the second flight portion comprises at least two flight segments which define a second pitch distance which is greater than the first pitch distance.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
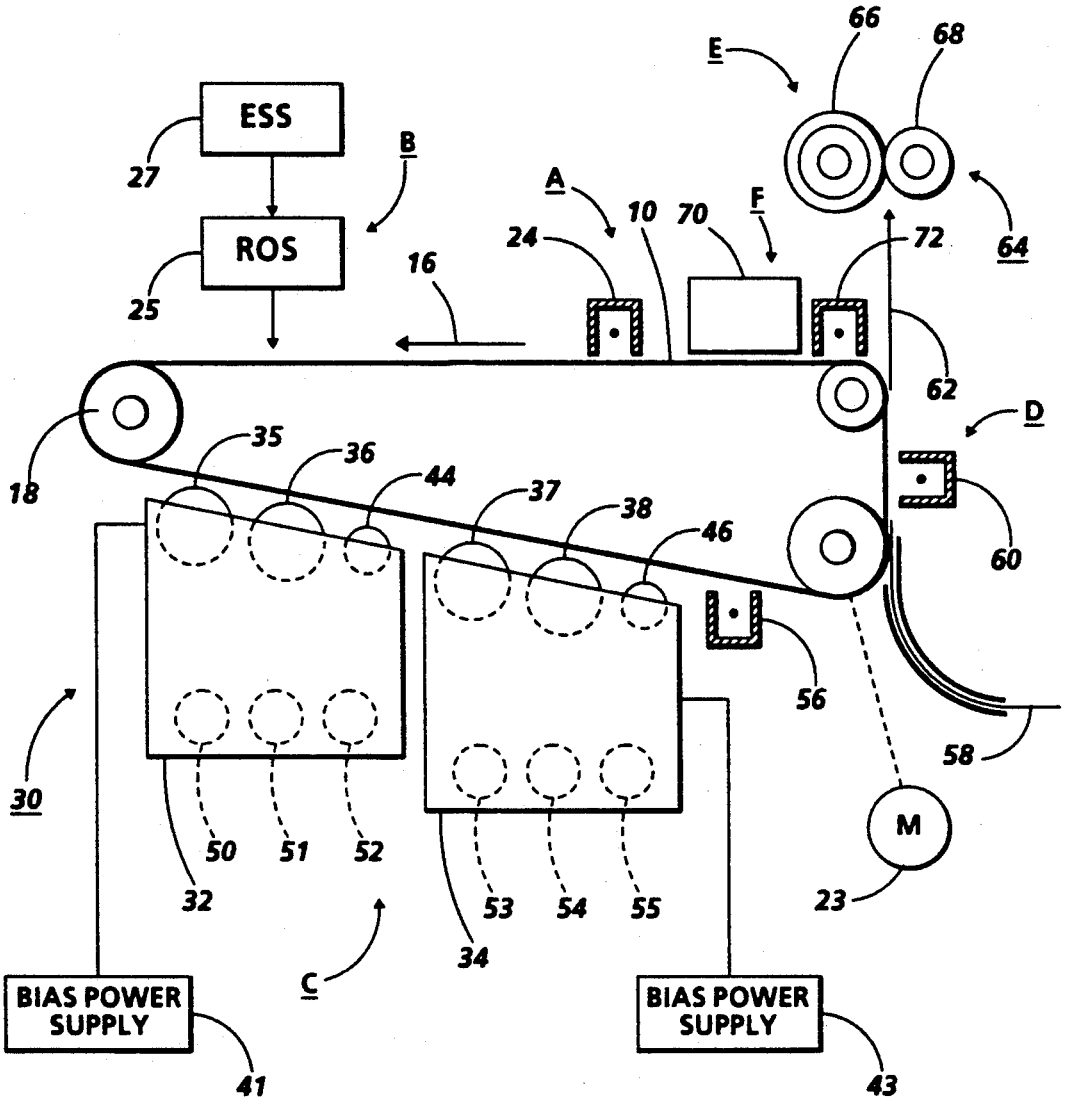
FIG. 1 is a schematic elevational view of an illustrative electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine incorporating the features of the present invention therein. It will become evident from the following discussion that the present invention is equally well suited for use in a wide variety of printing machines, and is not necessarily limited in its application to the particular system shown herein.

Referring now to FIG. 1, the electrophotographic printing machine employs a belt 10, i.e. a charge retentive member, having a photoconductive surface deposited on a conductive substrate. Preferably, the photoconductive surface is made from a selenium alloy with the conductive substrate being made preferably from an electrically grounded aluminum alloy. Belt 10 moves in the direction of arrow 16 to advance successive portions thereof sequentially through the various processing stations disposed about the path of movement thereof. Belt 10 is entrained about tensioning roller 18, drive roller 20, and stripping roller 22. Motor 23 rotates roller 20 to advance belt 10 in the direction of arrow 16. Roller 20 is coupled to motor 23 by suitable means such as a belt drive.

Initially, successive portions of belt 10 pass through a charging station A. At charging station A, a corona discharging device, such as a scorotron, corotron or dicorotron indicated by the reference numeral 24, charges the belt 10 to a selectively high uniform positive or negative potential. Preferably charging is negative. Any suitable control, well known in the art, may be employed for controlling corona discharge device 24.

Next, the charged portions of the photoconductive surface are advanced through an exposure station B. At exposure station B, the uniformly charged photoconductive surface or charge retentive surface is exposed to a laser based input and/or output scanning device 25 which causes the charge retentive surface to be discharged in accordance with the output from the scanning device. Preferably the scanning device is a three level laser Raster Output Scanner (ROS). An electronic sub system (ESS) 27 provides the control electronics which prepare the image data flow between a data source (not shown) and ROS 25. Alternatively, the ROS and ESS may be replaced by a conventional light/lens exposure device. The photoconductive surface, which is initially charged to a relatively high charge potential (about 900 volts), is selectively discharged to a midway potential (about 500 volts) in the background (white) image areas and to near zero or ground potential in the highlight (i.e. color other than black) color parts of the image.

At a development station C, a magnetic brush development system, indicated generally by the reference numeral 30, advances developer material into contact with the electrostatic latent images. The development system 30 comprises first and second magnetic brush developer units 32 and 34, respectively. Preferably, each of the developer units includes a pair of magnetic brush developer rollers mounted in a housing. More specifically, developer unit 32 contains a pair of magnetic brush rollers 35 and 36, and further, developer unit 34 contains a pair of magnetic brush rollers 37 and 38. Each pair of rollers advances its respective developer material into contact with the latent image. In addition, each of the developer units 32 and 34 include a pick-off roller 44 and 46, respectively, for acquiring carrier granules which were improperly transferred to the latent image and returning such carrier granules to its respective development unit. Developer unit 32 further includes three developer augers 50, 51 and 52 while developer unit 34 further includes three developer augers 53, 54 and 55. Appropriate developer biasing is accomplished via power supplies 41 and 43 electrically connected to respective developer units 32 and 34.

Color discrimination in the development of the electrostatic latent image is achieved by moving the latent image recorded on the photoconductive surface past developer units 32 and 34 in a single pass with the magnetic brush rollers 35, 36, 37 and 38 electrically biased to voltages which are offset from the background voltage, the direction of offset depending on the polarity of toner in the housing. The first developer unit 32, in the direction of movement of belt 10 as indicated by arrow 16, develops the discharged image areas of the photoconductive surface. This developer unit contains red developer material (not shown) having triboelectric properties such that the red toner is driven to the discharged image areas of the latent image by the electrostatic field between the photoconductive surface and the electrically biased developer rollers in the first developer unit. Conversely, the second developer unit 34, in the direction of movement of belt 10 as indicated by arrow 16, develops the highly charged image areas of the latent image. This developer unit contains black developer material (not shown) having a triboelectric charge such that the black toner is urged towards the highly charged areas of the latent image by the electrostatic field existing between the photoconductive surface and the electrically biased developer rollers in the second developer unit.

A sheet of support material 58 is moved into contact with the toner image at a transfer station D. The sheet of support material is advanced to transfer station D by a conventional sheet feeding apparatus (not shown). Preferably, the sheet feeding apparatus includes a feed roller contacting the uppermost sheet of a stack of copy sheets. The feed roller rotates so as to advance the uppermost sheet from the stack into a chute which directs the advancing sheet of support material into contact with the photoconductive surface of belt 10 in a timed sequence so that the toner particle image developed thereon contacts the advancing sheet of support material at transfer station D.

Because the composite image developed on the photoreceptor consists of both positive and negative toner, a negative pre-transfer corona discharge member 56 is provided to condition the toner for effective transfer to the sheet using positive corona discharge.

Transfer station D includes a corona generating device 60 which sprays ions of a suitable polarity onto the backside of sheet 58. This attracts substantially simultaneously the black and non-black portions of the toner particle image from belt 10 to sheet 58. After transfer, the sheet continues to move, in the direction of arrow 62, onto a conveyor (not shown) which advances the sheet to a fusing station E.

Fusing station E includes a fuser assembly, indicated generally by the reference numeral 64, which permanently affixes the transferred toner particle image to sheet 58. Preferably, fuser assembly 64 comprises a heated fuser roller 66 and a pressure roller 68. Sheet 58 passes between fuser roller 66 and pressure roller 68 with the toner particle image contacting fuser roller 66. In this manner, the toner particle image is permanently affixed to sheet 58. After fusing, a chute (not shown) guides the advancing sheet 58 to a catch tray (not shown) for subsequent removal from the printing machine by the operator.

After the sheet of support material is separated from photoconductive surface of belt 10, the residual toner particles carried by the non-image areas on the photoconductive surface are charged to a suitable polarity and level by a preclean charging device 72 to enable removal therefrom. These particles are removed at a cleaning station F. A vacuum assisted, electrostatic, fur brush cleaner unit 70 is disposed at the cleaning station F. The cleaning unit has two fur brush rolls that rotate at relatively high speeds which create mechanical forces that tend to sweep the residual toner particles into an air stream (provided by a vacuum source), then into a cyclone separator, and finally into a waste bottle. In addition, the brushes are triboelectrically charged to a very high negative potential which enhances the attraction of the residual toner particles to the brushes and increases the cleaning performance.

Subsequent to cleaning, a discharge lamp (not shown) floods the photoconductive surface with light to dissipate any residual electrostatic charge remaining prior to the charging thereof for the next successive imaging cycle.

Figure 2:
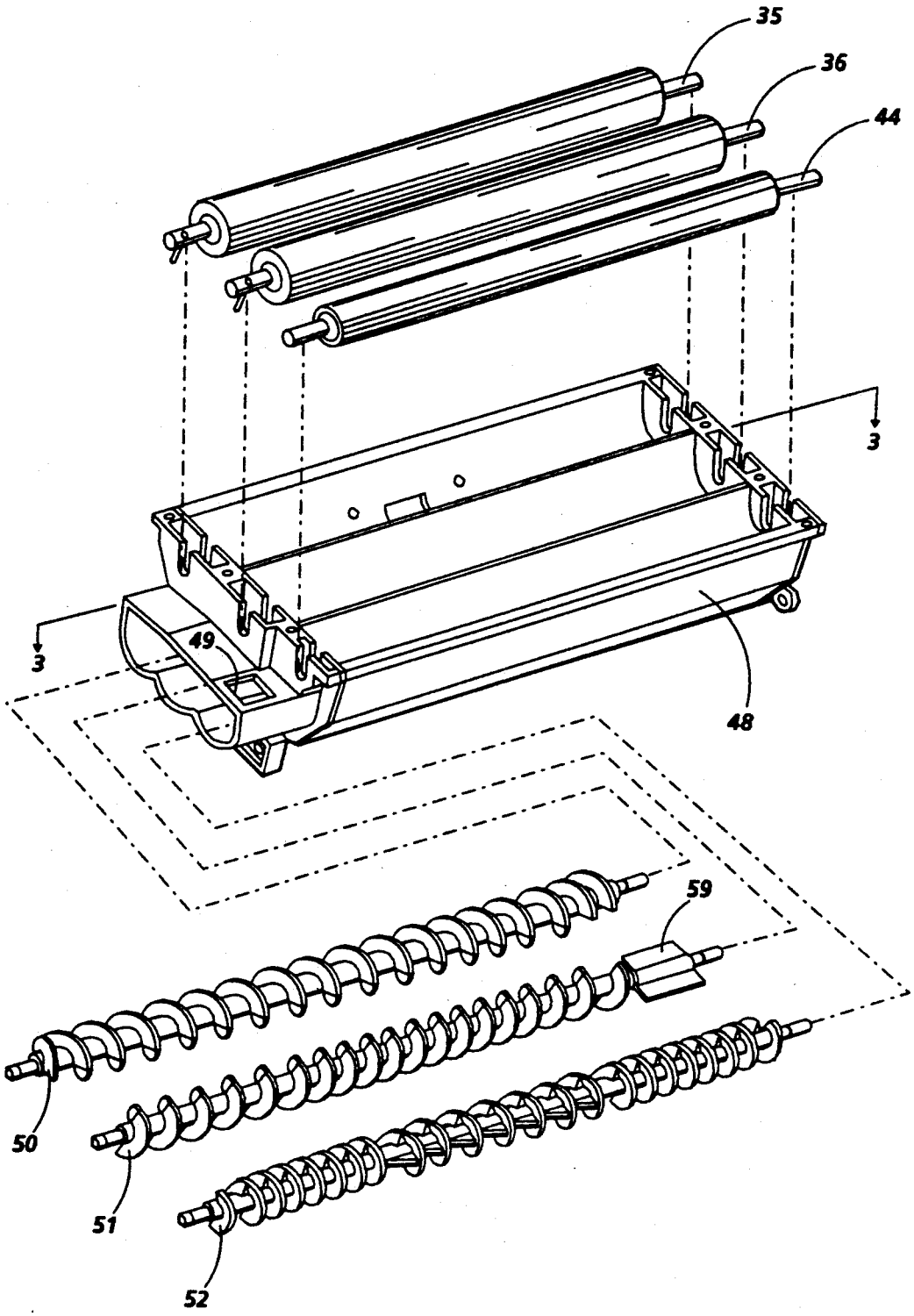
FIG. 2 is an exploded perspective view showing one of the developer units used in the electrophotographic printing machine of FIG. 1.
Figure 3:
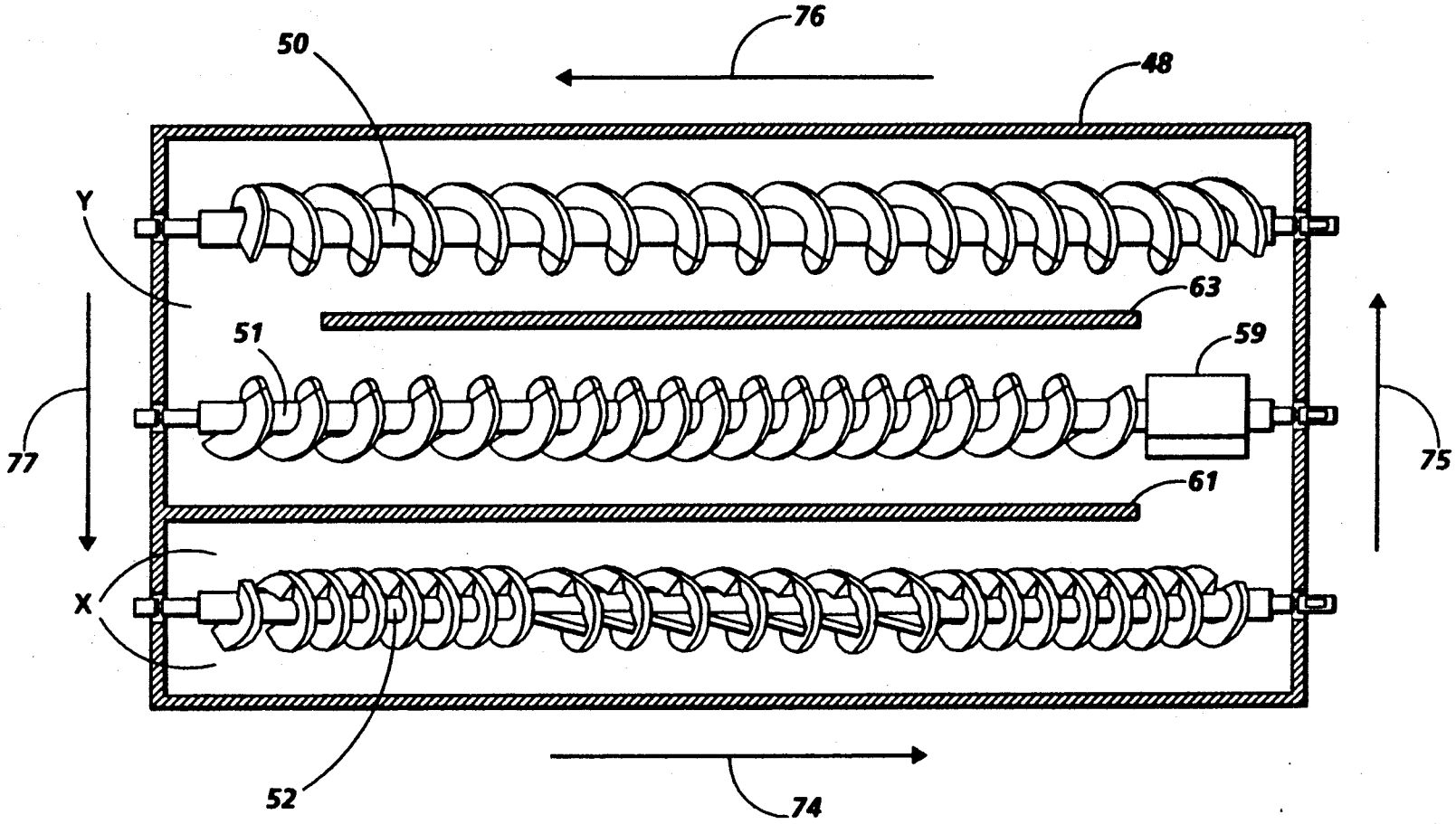
FIG. 3 is a sectional view taken in the direction of arrows 3—3 of FIG. 2.

Referring now to FIG. 2, developer unit 32 is shown in greater detail. Development units 32 and 34 are substantially identical in structure to one another and thus only developer unit 32 will be described. Development unit 32 includes a housing 48 which supports magnetic brush rollers 35 and 36, pick-off roller 44 and developer augers 50, 51 and 52. Housing 48 includes a toner inlet opening 49 through which fresh toner particles are added to the existing developer material from a toner particle source (not shown). As shown in FIG. 3, housing 48 further includes a pair of partition plates 61 and 63. The partition plates prevent interaction of the adjacent and opposite flows of developer material. Without partition plates 61 and 63, the developer material being pushed in paths of movement of opposite directions by the three developer augers would tend to collide with each other and stagnate between the paths of movement of the developer material.

New toner particles enter the existing developer material at a location X through opening 49. Auger 52 then advances the mixture of the fresh toner particles and the existing developer material in the direction of arrow 74. A paddle wheel 59, which is positioned on auger 51, then advances the developer material in the direction of arrow 75. Subsequently, auger 50 advances the developer material in the direction of arrow 76. The developer material is then forced in the direction of arrow 77 and through the opening defined between partition plate 63 and the side of the housing near point Y. The developer material then comes under the influence of the flight of auger 51 and is advanced back in the direction of arrow 74. Upon arriving at paddle wheel 59, the developer material is forced in the direction of arrow 75 and thereafter is advanced in a path of an endless loop as described above.

Figure 4:
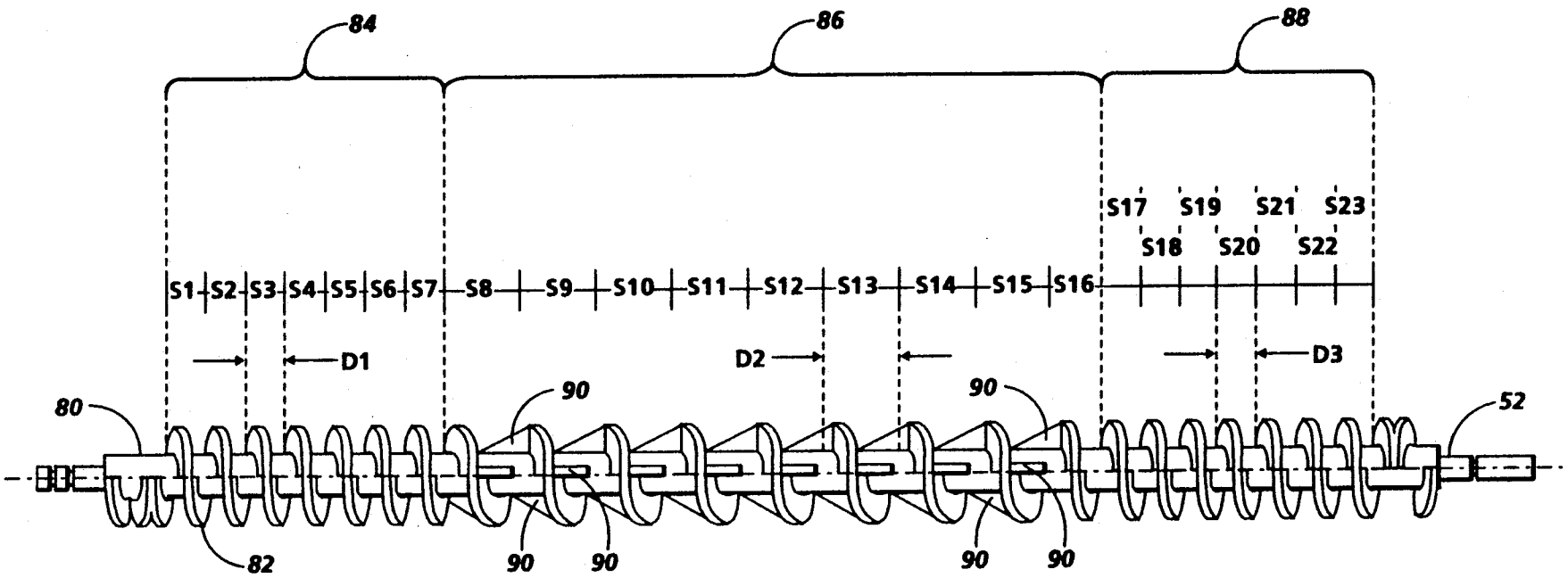
FIG. 4 is an enlarged elevational view showing the mixing auger of the developer unit of FIG. 2.

Turning now to FIG. 4, there is shown an enlarged view of auger 52. Auger 52 includes a shaft 80 and a flight 82. Flight 82 possesses a plurality of flight segments S1–S23. A first portion 84 of flight 82 includes flight segments S1–S7. A second portion 86 of flight 82 includes flight segments S8–S16. A third portion 88 of flight 82 includes flight segments S17–S23. Flight segments S1–S7 are axially aligned along shaft 80 and each such flight segment is spaced apart from a similar adjacent flight segment by a pitch distance of D1. The pitch distance between adjacent flight segments within a similar flight portion would be defined as the distance from any point on a flight segment of the auger to the corresponding point on an adjacent flight segment within a similar flight portion measured parallel to the axis of shaft 80. Further, flight segments S8–S16 are axially aligned along shaft 80 and each such flight segment is spaced apart from a similar adjacent flight segment by a pitch distance of D2. Flight segments S17–S23 are axially aligned along shaft 80 and each such flight segment is spaced apart from a similar adjacent flight segment by a pitch distance of D3. As shown in FIG. 4, pitch distance D1 is substantially less than pitch distance D2 while pitch distance D1 is approximately equal to pitch distance D3.

Providing a developer auger which possesses adjacent flight portions each having a different pitch distance between adjacent flight segments thereof along the length of the auger functions to alter the rate of speed at which the developer material is propelled within a developer housing. For example, the rate of speed at which the developer material would be propelled by a flight portion having a pitch distance of D1 is less than the rate of speed at which the developer material would be propelled by another flight portion having a pitch distance of D2.

Auger 52 further includes a plurality of mixing vanes 90 which are secured to shaft 80 within second flight portion 86 as shown in FIG. 4. Each of mixing vanes 90 are also secured to an adjacent flight segment. As shaft 90 is rotated to turn flight 82 in order to advance the developer material within housing 48, mixing vanes 90 function to mix newly added toner particles with existing developer material to achieve substantial blending thereof prior to bringing the developer mixture into contact with the electrostatic image.

The action of mixing vanes 90 upon the developer material tends to reduce the rate of speed at which the developer material is propelled along the length of shaft 80 within housing 48. However, since mixing vanes 90 are located within second portion 86 of flight 82 which possess flight segments having an increased pitch distance relative to the pitch distance of the flight segments within first portion 84 of flight 82, the effect of the mixing vanes on the rate of speed of the developer material within the housing is substantially offset. Therefore, the developer material is propelled by auger 52 through first flight portion 84, second flight portion 86 and third flight portion 88 at a substantially constant rate of speed while providing for significant blending of the developer material.

In recapitulation, a developer auger possessing a plurality of flight segments is described for use in a development system of an electrophotographic printing machine. The developer auger comprises a shaft and a first flight portion, spirally mounted on the shaft, wherein the first flight portion comprises at least two flight segments which define a first pitch distance. The developer auger further comprises a second flight portion, spirally mounted on the shaft and positioned adjacent the first flight portion, wherein the second flight portion comprises at least two flight segments which define a second pitch distance which is greater than the first pitch distance.

It is, therefore, apparent that there has been provided in accordance with the present invention, a developer auger for use in the development system of an electrophotographic printing machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A developer auger possessing a plurality of flight segments for use in a development system of an electrophotographic printing machine comprising:

a shaft;

a first flight portion, mounted on said shaft, comprising at least two flight segments which define a first pitch distance;

a second flight portion, mounted on said shaft and positioned adjacent said first flight portion, comprising at least two flight segments which define a second pitch distance which is greater than the first pitch distance; and a vane mounted within said second flight portion.

2. The developer auger of claim 1, wherein said vane is mounted on said shaft.

3. The developer auger of claim 1, further comprising a plurality of vanes which are mounted within said second flight portion.

4. The developer auger of claim 3, wherein said plurality of vanes are mounted on said shaft.

5. The developer auger of claim 1, further comprising a third flight portion, mounted on said shaft and positioned adjacent the second flight portion, comprising at least two flight segments which define a third pitch distance which is less than the second pitch distance.

6. The developer auger of claim 5, wherein said second flight portion is interposed between said first flight portion and said third flight portion.

7. The developer auger of claim 5, wherein said first pitch distance is substantially equal to said third pitch distance.

8. An electrophotographic printing machine of the type having a development system which transports developer material for subsequent image development that includes a developer auger possessing a plurality of flight segments comprising:

a shaft;

a first flight portion, mounted on said shaft, comprising at least two flight segments which define a first pitch distance;

a second flight portion, mounted on said shaft and positioned adjacent said first flight portion, comprising at least two flight segments which define a second pitch distance which is greater than the first pitch distance; and a vane mounted within said second flight portion.

9. The developer auger of claim 8, wherein said vane is mounted on said shaft.

10. The developer auger of claim 8, further comprising a plurality of vanes which are mounted within said second flight portion.

11. The developer auger of claim 10, wherein said plurality of vanes are mounted on said shaft.

12. The developer auger of claim 8, further comprising a third flight portion, mounted on said shaft and positioned adjacent the second flight portion, comprising at least two flight segments which define a third pitch distance which is less than the second pitch distance.

13. The developer auger of claim 12, wherein said second flight portion is interposed between said first flight portion and said third flight portion.

14. The developer auger of claim 12, wherein said first pitch distance is substantially equal to said third pitch distance.

* * * * *